US006302024B1

(12) United States Patent
Swart et al.

(10) Patent No.: US 6,302,024 B1
(45) Date of Patent: Oct. 16, 2001

(54) INTEGRATED CIRCUIT CONFIGURATION FOR HEATING IGNITION MATERIAL, AND TRIGGER ASSEMBLY WITH THE INTEGRATED CIRCUIT CONFIGURATION

(75) Inventors: Marten Swart, Obertraubling; Ekkehart-Peter Wagner, Bad Abbach; Horst Belau, Langquaid; Stefan Kösters, München, all of (DE); Hubert Rothleitner, Villach (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/596,894

(22) Filed: Jun. 19, 2000

Related U.S. Application Data

(63) Continuation of application No. PCT/DE98/03672, filed on Dec. 15, 1998.

(30) Foreign Application Priority Data

Dec. 18, 1997 (DE) ..... 197 56 563

(51) Int. Cl.[7] ..... F42B 3/10
(52) U.S. Cl. ..... 102/202.5; 102/202.7
(58) Field of Search ..... 102/202.4, 202.5, 102/202.7, 202.6

(56) References Cited

U.S. PATENT DOCUMENTS 4,831,933 * 5/1989 Nerheim et al. .
4,843,964 7/1989 Bickes, Jr. et al. .
4,976,200 * 12/1990 Benson et al. .
5,370,053 * 12/1994 Williams et al. .
5,912,427 * 6/1999 Willis et al. .
6,178,888 * 1/2001 Neyer et al. .
6,192,802 * 2/2001 Baginski .
6,199,484 * 3/2001 Martinez-Tovar et al. .

FOREIGN PATENT DOCUMENTS 35 37 820 A1 4/1987 (DE) .
197 02 118 C1 3/1998 (DE) .
196 53 115 A1 6/1998 (DE) .
2 190 730 A 11/1987 (GB) .

* cited by examiner

*Primary Examiner*—Charles T. Jordan
*Assistant Examiner*—Troy Chambers
(74) *Attorney, Agent, or Firm*—Herbert L. Lerner; Laurence A. Greenbe; Werner H. Stemer

(57) ABSTRACT

An integrated circuit configuration has both an ignition resistor and a control circuit that controls a current flow through the ignition resistor. A region of a semiconductor layer that electrically connects the integrated components is used as the ignition resistor. An electrically conductive layer for making electrical contact with the control circuit and a semiconductor layer for the components has a cutout in the region of the ignition resistor and ignition material is in direct contact with the integrated circuit configuration at the ignition region.

5 Claims, 2 Drawing Sheets

INTEGRATED CIRCUIT CONFIGURATION FOR HEATING IGNITION MATERIAL, AND TRIGGER ASSEMBLY WITH THE INTEGRATED CIRCUIT CONFIGURATION

CROSS-REFERENCE TO RELATED APPLICATION

This is a continuation of copending International Application PCT/DE98/03672, filed Dec. 15, 1998, which designated the United States.

BACKGROUND OF THE INVENTION

Field of the Invention

The invention relates to an integrated circuit configuration for heating ignition material, and to a use of such an integrated circuit configuration.

A previously considered integrated circuit configuration for heating ignition material contained a silicon substrate with a heavily doped heating zone as an ignition resistor. The region of the heating zone has a smaller cross section than the remaining region of the silicon substrate.

U.S. Pat. No. 4,831,933 discloses an integrated circuit configuration for heating ignition material which has a heating element in the form of a polysilicon strip applied on a silicon substrate. A cutout in the silicon substrate in the region of the heating element is intended to prevent heat outflow from the latter.

SUMMARY OF THE INVENTION

The object of the invention is to provide an integrated circuit configuration for heating ignition material which overcomes the above-noted deficiencies and disadvantages of the prior art devices and methods of this kind, and which further allows the integration of a driver circuit for the ignition resistor and nevertheless permits good heat transfer from the ignition resistor to the ignition material.

With the above and other objects in view there is provided, in accordance with the invention, a trigger assembly, comprising:

- an integrated circuit configuration for heating ignition material, the circuit configuration having:
  - a first semiconductor layer formed with components of a control circuit;
  - a further semiconductor layer electrically connecting the components and having an ignition region forming an ignition resistor connected to the control circuit, the control circuit controlling a current flow through the ignition resistor;
  - an electrically conductive layer for making electrical contact with the control circuit;
  - the electrically conductive layer and the first semiconductor layer having a cutout formed at the ignition region; and
  - ignition material in direct contact with the circuit configuration.

In accordance with an additional feature of the invention, a polysilicon layer is provided on the first semiconductor layer and an insulating layer isolating the polysilicon layer from the first semiconductor layer, and wherein the electrically conductive layer is arranged on the polysilicon layer and isolated therefrom with a further insulating layer.

In accordance with an added feature of the invention, further layers are arranged on the electrically conductive layer, and the further layers being formed with a cutout in the ignition region.

With the above and other objects in view there is also provided an igniter for triggering an occupant protection device in a motor vehicle. The igniter comprises the above-outlined trigger assembly in which the ignition material is a gas generator material.

In accordance with a concomitant feature of the invention, the ignition material in the ignition region of the ignition resistor bears on an electrical insulating layer covering the polysilicon layer.

Other features which are considered as characteristic for the invention are set forth in the appended claims.

Although the invention is illustrated and described herein as embodied in an integrated circuit configuration for heating ignition material, and use of such an integrated circuit configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
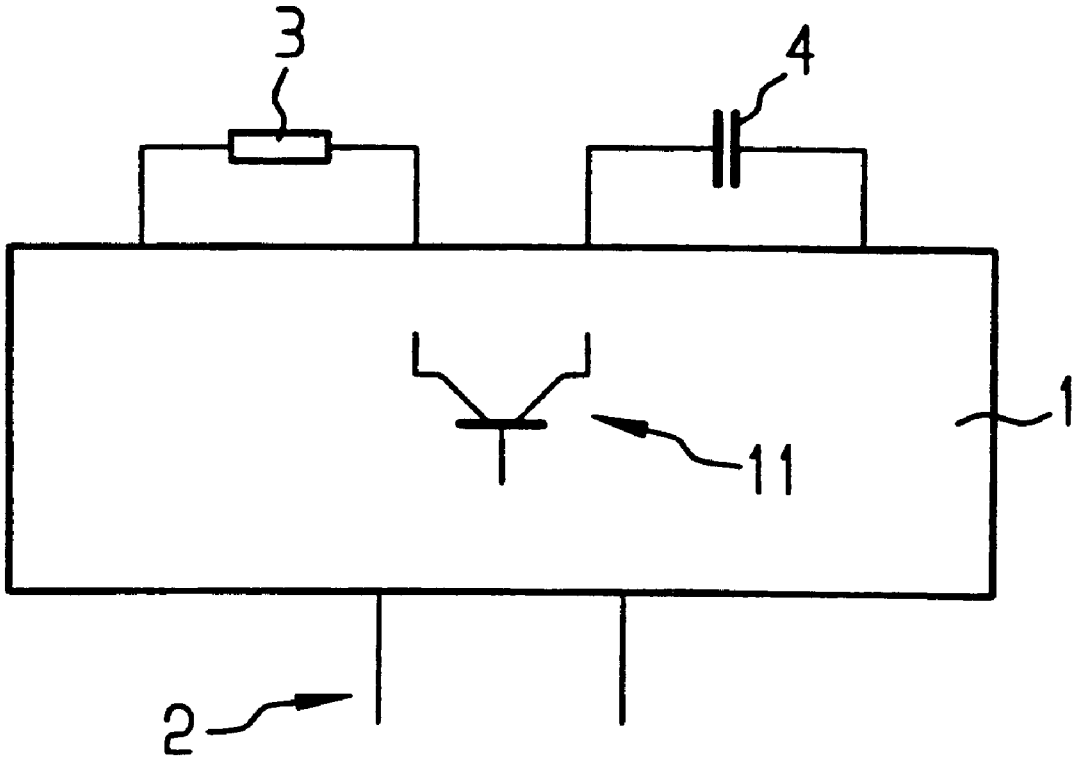
FIG. 1 is an electrical equivalent circuit diagram of an igniter for triggering an occupant protection device of a motor vehicle.

Referring now to the figures of the drawing in detail and first, particularly, to FIG. 1 thereof, there is seen an electrical equivalent circuit diagram of an igniter which is used, in particular, for triggering an occupant protection device in a motor vehicle. In such an occupant protection system, a control unit is typically centrally disposed in the vehicle, and is connected via a bus line to various igniters of occupant protection devices such as airbags, seat belt pretensioners, and the like. If the control unit identifies an impact based on a given acceleration or body deformation, then selected igniters are activated by means of corresponding ignition commands. Each igniter is thereby arranged in a gas generator housing which opens, for example, into a folded-up airbag. A control circuit 1 of the igniter evaluates messages received via a bus link 2 and applies a sufficiently large current pulse to an ignition resistor 3 that is electrically connected to it. The energy is thereby supplied by an ignition capacitor 4 and forwarded to the ignition resistor 3 via a controllable power stage 11. In this case, the control circuit 1, the ignition resistor 3, and the ignition capacitor 4 are accommodated in a housing of the igniter. Ignition material, e.g. ignition or detonator powder, is likewise arranged in the housing, around the ignition resistor 3. When the ignition resistor 3 is heated, the ignition powder explodes on account of the heat transfer. Energy liberated by the explosion causes pellets of the gas generator to release gas which streams out into the folded airbag and thus causes the airbag to inflate.

Figure 2:
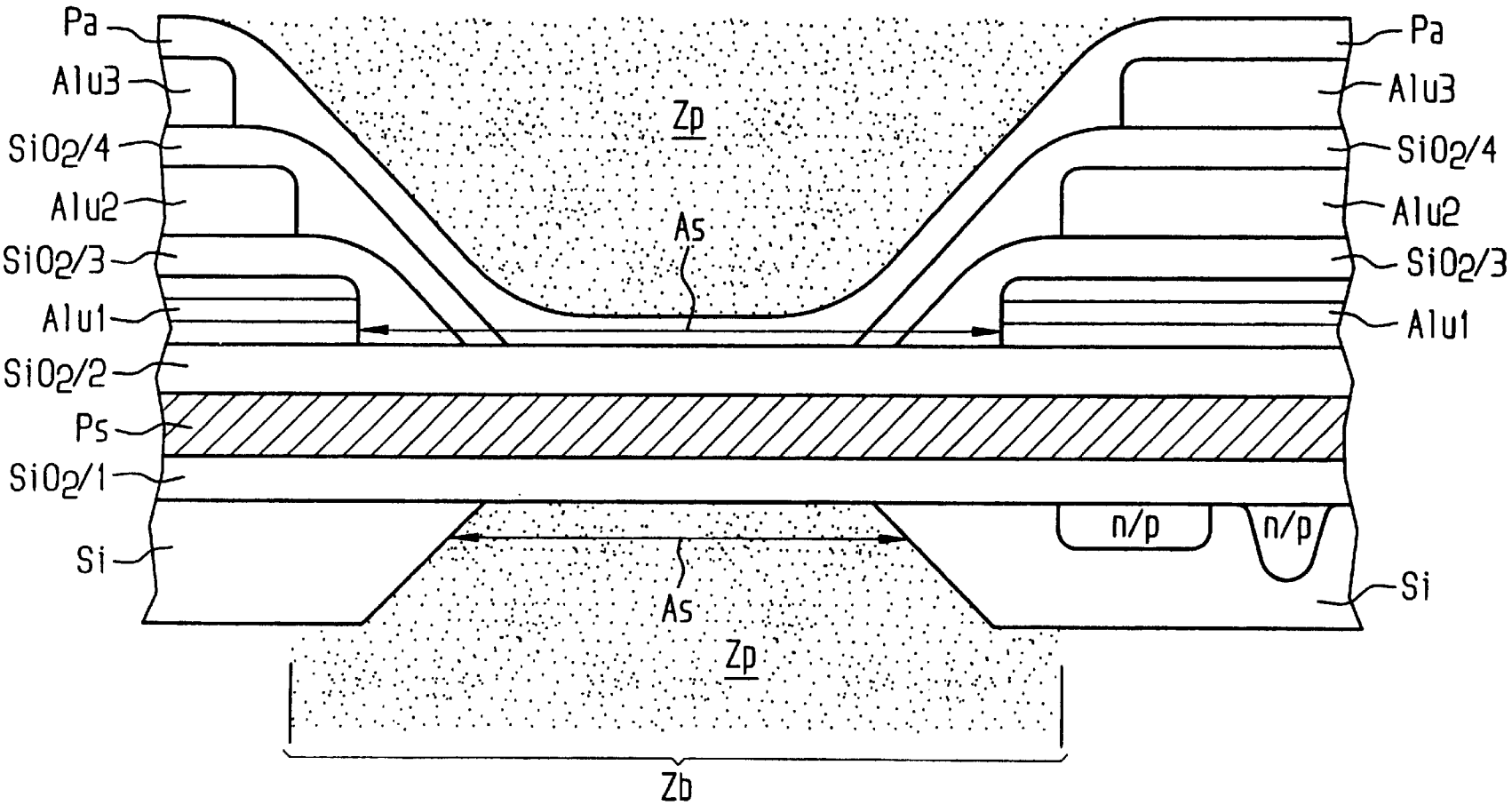
FIG. 2 shows a structural section of a layer model of an integrated circuit configuration according to the invention.

Referring now to FIG. 2, there is shown an exemplary embodiment of the integrated circuit configuration according to the invention which is provided for the purpose of heating ignition material. The integrated circuit configuration combines the ignition resistor and the control circuit according to FIG. 1 on a common semiconductor substrate. A semiconductor layer Si, preferably a silicon substrate, contains components of the control circuit in the form of doped regions n/p. A further semiconductor layer Ps, preferably a polysilicon layer, is applied on the semiconductor layer Si, but with isolation provided by an insulating layer $SiO_2/1$, which is preferably designed as a silicon oxide layer. Instead of the polysilicon layer Ps, it is possible to use any other electrically conductive layer with a non-reactive resistance. The polysilicon layer Ps serves for electrically connecting the components which are arranged in the semiconductor layer Si. To that end, non-illustrated plated-through holes are provided from the polysilicon layer Ps through the insulating layer $SiO_2/1$ to the semiconductor layer Si. Furthermore, non-reactive resistors or capacitor electrodes, for example, can be realized by the polysilicon layer Ps.

Electrically conductive layers Alu1, Alu2 and Alu3, each isolated from one another by insulating layers $SiO_2/2$, $SiO_2/3$, $SiO_2/4$, are applied on the polysilicon layer Ps. These electrically conductive layers Alu1, Alu2, Alu3 serve for making electrical contact with the control circuit. To that end, vertical plated-through holes extending as far as the polysilicon layer and the semiconductor layer are necessary. These electrically conductive layers Alu1, Alu2, Alu3 are preferably produced from aluminum.

According to the invention, therefore, the integrated circuit configuration according to FIG. 2 contains not only the control circuit for the ignition resistor of the igniter, but also the ignition resistor itself. It is realized by a region Zb of the polysilicon layer Ps. The ignition region Zb in the polysilicon layer Ps is designed in such a way that it preferably has a non-reactive resistance of 1–20 ohms. In the ignition region Zb, the cross section of the polysilicon layer is tapered. Such shaping of the polysilicon layer Ps results in an ignition element in the form of a heating resistance bridge in the ignition region Zb. The location that is tapered in this way ensures that electrical energy in the form of a current flowing from a capacitor via the tapered location is converted into thermal energy precisely at this tapered, low-resistance location. As a result, an ignition material/ignition powder that is arranged at or near the tapered region is caused to explode. To that end, the ignition region may be designed to be tapered in its width or height. At any rate, the cross-sectional area of the polysilicon layer in the tapered region—that is to say in the region in which the heating effect is intended to be obtained—is less than in the region in which the polysilicon layer acts principally as a wiring layer.

According to the invention, the electrically conductive layers Alu1, Alu2 and Alu3 and the insulating layers $SiO_2/3$ and $SiO_2/4$ have cutouts As in the ignition region Zb. These cutouts As are necessary in order to ensure a good heat transfer from the ignition resistor realized in the polysilicon layer Ps to the ignition material Zp. In the exemplary embodiment according to FIG. 2, the entire integrated circuit configuration is embedded in such ignition material Zp. In the exemplary case, the ignition material Zp is preferably pressed onto the integrated circuit configuration in particular in the ignition region Zb and the ignition material Zp is in direct contact with the triggering circuit. If the integrated circuit configuration has just one electrically conductive layer Alu1, then of course only this electrically conductive layer contains the cutout As.

The cutouts As are produced by etching in a standard semiconductor process. The insulating layer $SiO_2/2$ arranged directly on the polysilicon layer Ps is preferably used as an etching stop for the etching process. The cutout regions As produced by etching can be created with small tolerances and can thus be matched exactly to the ignition region Zb.

The invention thus has the major advantage that the ignition resistor and control circuit for the ignition resistor can be integrated in a single integrated circuit configuration and, at the same time, a good heat transfer from the ignition pellet resistor to the ignition powder is ensured. In addition, the advantageous heat transfer is produced with little outlay and precise tolerances by virtue of the cutouts being formed on the basis of standard etching processes.

It is evident from FIG. 2 that the invention also makes it possible, exclusively or else in addition to the cutout in the electrically conductive layer Alu1, to etch a cutout As into the semiconductor layer Si in the ignition region Zb, in order to ensure from this side a good thermal link between the ignition resistor and the ignition material Zp. In this case, the ignition material Zp preferably always bears on the side on which the cutout As has been etched free.

If the circuit configuration is intended to be arranged on a carrier using flip-chip technology—i.e., the circuit configuration is placed directly by contact areas of one of the electrically conductive layers on mating contact areas of a carrier—then it is advantageous for only the semiconductor layer Si to be provided with the cutout As. Ignition material Zp is pressed onto the circuit configuration from the side of the semiconductor layer Si.

We claim:

1. A trigger assembly, comprising:

an integrated circuit configuration for heating ignition material, said circuit configuration having:

a first semiconductor layer formed with components of a control circuit;

a further semiconductor layer electrically connecting said components and having an ignition region forming an ignition resistor connected to said control circuit, said control circuit controlling a current flow through said ignition resistor;

an electrically conductive layer for making electrical contact with said control circuit;

said electrically conductive layer and said first semiconductor layer having a cutout formed at said ignition region; and ignition material in direct contact with said circuit configuration.

2. The trigger assembly according to claim 1, which further comprises a polysilicon layer on said first semiconductor layer and an insulating layer isolating said polysilicon layer from said first semiconductor layer, and wherein said electrically conductive layer is arranged on said polysilicon layer and isolated therefrom with a further insulating layer.

3. The trigger assembly according to claim 2, wherein further layers are arranged on said electrically conductive layer, and said further layers being formed with a cutout in said ignition region.

4. An igniter for triggering an occupant protection device in a motor vehicle, comprising a trigger assembly with an integrated circuit configuration for heating ignition material, said circuit configuration having:

a first semiconductor layer formed with components of a control circuit;

a further semiconductor layer electrically connecting said components and having an ignition region forming an ignition resistor connected to said control circuit, said control circuit controlling a current flow through said ignition resistor;

an electrically conductive layer for making electrical contact with said control circuit;

said electrically conductive layer and said first semiconductor layer having a cutout formed at said ignition region; and ignition material in direct contact with said circuit configuration, said ignition material being disposed to cause gas generator material to release gas.

5. The igniter according to claim 4, wherein said ignition material in said ignition region of said ignition resistor bears on an electrical insulating layer covering said polysilicon layer.

* * * * *